US005522577A

United States Patent [19]

Roesch

[11] Patent Number: 5,522,577

[45] Date of Patent: Jun. 4, 1996

[54] CEILING FAN SUPPORT ARRANGEMENT

[75] Inventor: Mark Roesch, Brecksville, Ohio

[73] Assignee: The Lamson & Sessions Co., Cleveland, Ohio

[21] Appl. No.: 259,302

[22] Filed: Jun. 13, 1994

[51] Int. Cl.[6] ..... F16M 13/00

[52] U.S. Cl. ..... 248/343; 248/906; 248/205.1; 52/39

[58] Field of Search ..... 248/343, 906, 248/205.1, 27.1, 342, 344; 220/3.2, 3.5, 3.9; 174/63; 52/39, 28, 698, 699, 700

[56] References Cited

U.S. PATENT DOCUMENTS

| | | | |
|---|---|---|---|
| Re. 33,147 | 1/1990 | Reiker . | |
| 922,623 | 5/1909 | Parrish . | |
| 1,486,896 | 3/1924 | Hubbell . | |
| 1,488,078 | 3/1924 | Vandy . | |
| 1,751,262 | 3/1930 | Brown . | |
| 1,775,768 | 9/1930 | Kenerson . | |
| 2,374,993 | 5/1945 | Haynes . | |
| 2,448,001 | 8/1948 | Maurette . | |
| 2,684,220 | 7/1954 | Beber et al. . | |
| 2,876,394 | 3/1959 | Gerrish | 248/343 X |
| 3,676,570 | 7/1972 | Gabb . | |
| 3,949,155 | 4/1976 | Bourne . | |
| 4,548,554 | 10/1985 | Angott . | |
| 4,684,092 | 8/1987 | Reiker . | |
| 4,919,292 | 4/1990 | Hsu | 248/343 X |
| 4,988,067 | 1/1991 | Propp et al. . | |

*Primary Examiner*—Karen J. Chotkowski

*Attorney, Agent, or Firm*—Fay, Sharpe, Beall, Fagan, Minnich & McKee

[57] ABSTRACT

A mounting assembly for supporting a ceiling fan from a ceiling includes a support beam located inwardly of the ceiling surface at least a distance t. An electrical box having a bottom wall is directly joined to and supported from said support beam. The box has side walls extending from the bottom wall through the ceiling substantially to the exposed ceiling surface and terminating in an open end. A rigid metal plate or disk member adapted for supporting and mounting a ceiling fan is positioned over the open end of the box. The disk member is of a size sufficient to have a peripheral portion extending radially beyond the side walls of the box; and, a plurality of mounting screws extend from the metal disk member through the interior of the box into connected engagement with the beam for supporting the disk member from the beam without reliance on the electrical box.

10 Claims, 3 Drawing Sheets

FIG. 1
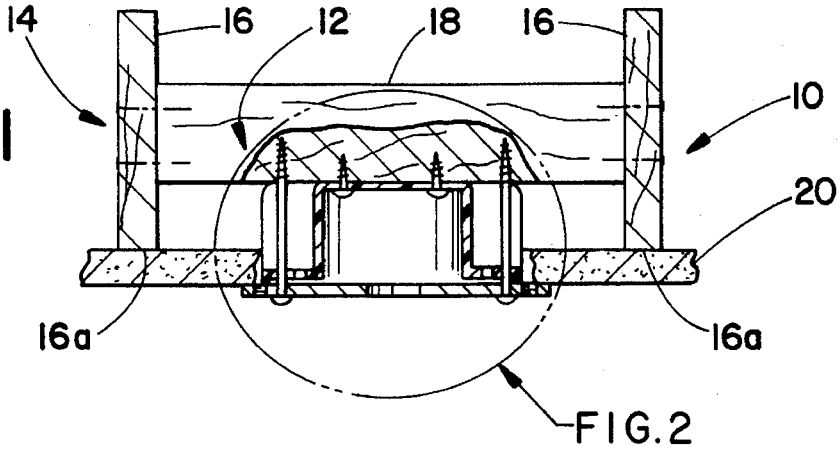
FIG. 2
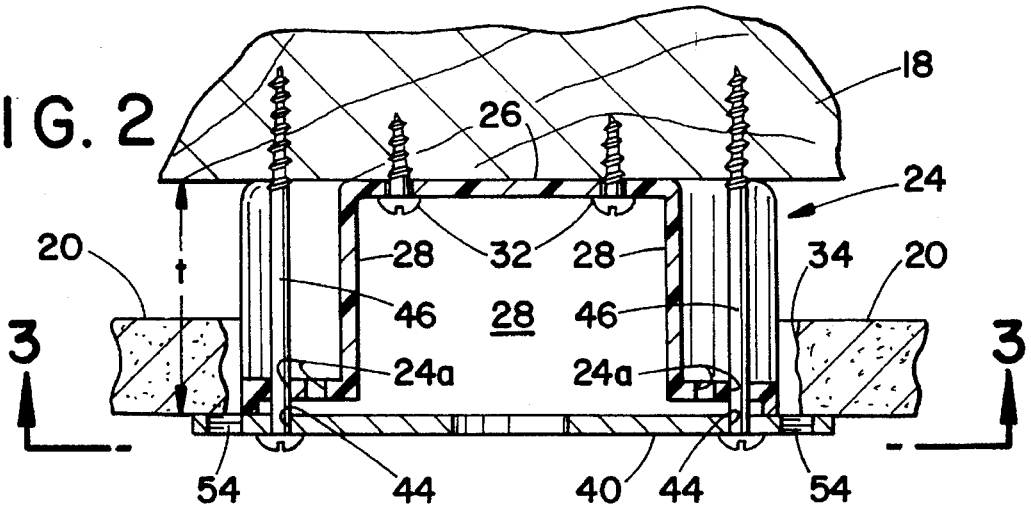
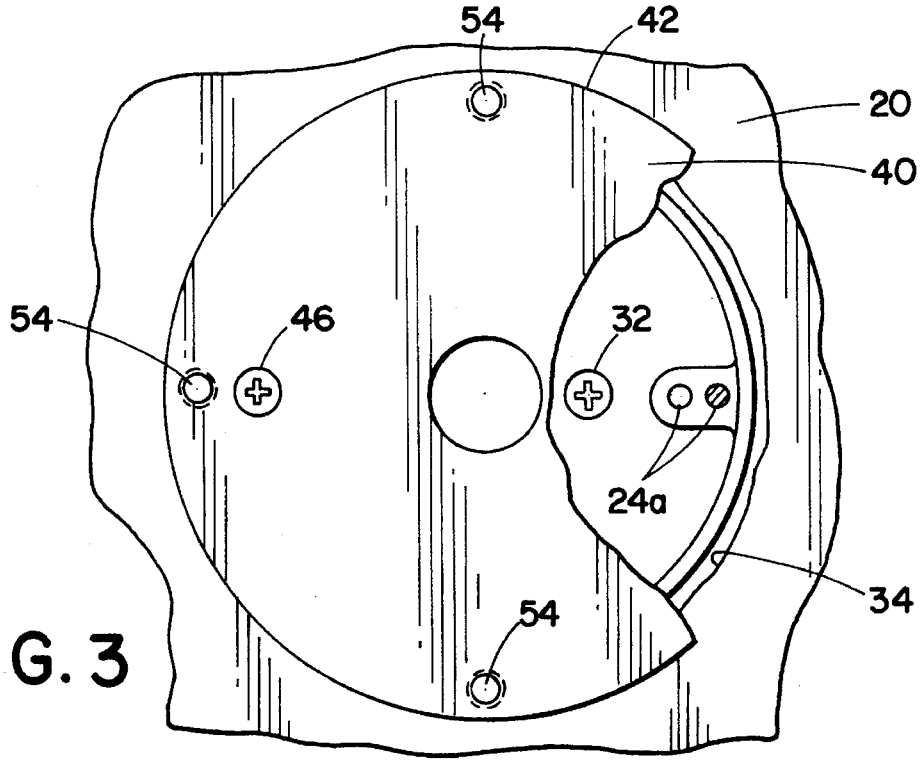
FIG. 3

FIG. 4
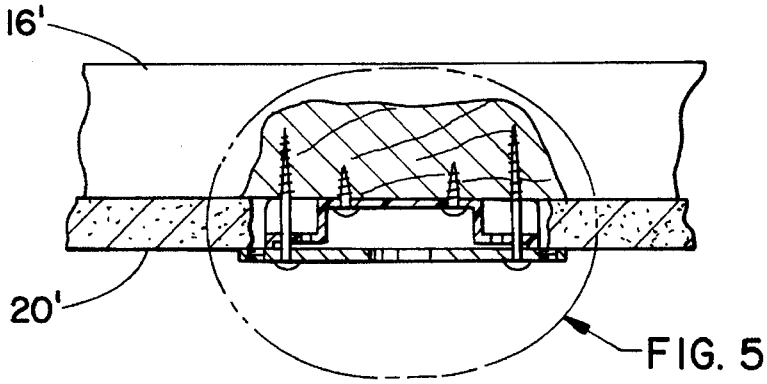
FIG. 5
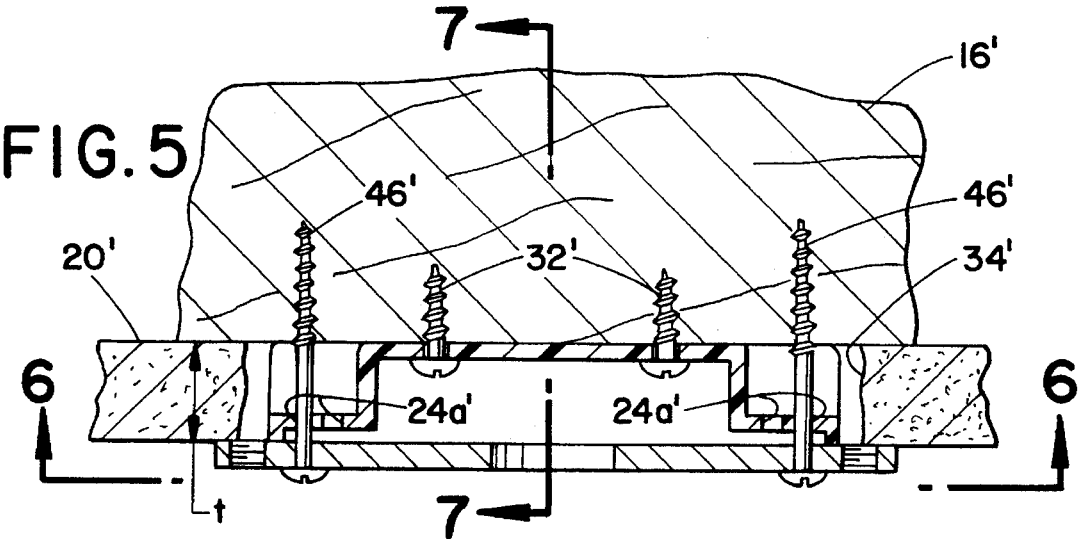
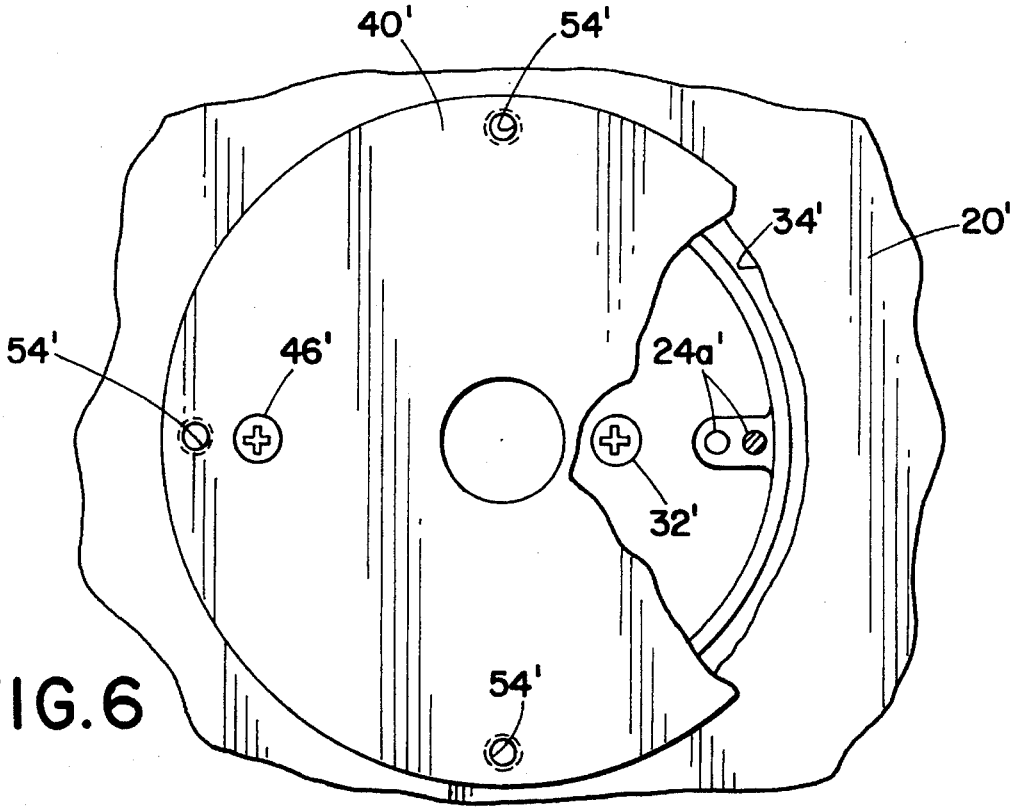
FIG. 6

CEILING FAN SUPPORT ARRANGEMENT

BACKGROUND OF THE INVENTION

The subject invention is directed toward the art of electrical boxes and, more particularly, to an arrangement for mounting and supporting ceiling fans without relying on the associated electrical box for support.

Ceiling fans present special mounting problems because of their size and weight, as well as because of the vibrations and forces they generate during operation. Typically, such fans are mounted and supported by brackets or plates bolted or screwed into the associated electrical box previously installed for a ceiling lighting fixture or the like. The total support for the fan is thus supplied by the electrical box which is assumed to have sufficient strength and to be adequately supported from the superjacent structure.

Even in new construction, the use of the electrical box as support for the fan is sometimes carried out without full consideration of the loads and operating forces encountered.

SUMMARY OF THE INVENTION

The subject invention provides an improved electrical box and ceiling fan support arrangement which can be used in either existing buildings or new construction. The arrangement eliminates the box as a load carrying element insofar as support of the fan is concerned.

In accordance with one aspect of the invention, there is provided an assembly for mounting the ceiling fan to a wood beam member that is a distance t above the ceiling surface. The assembly includes an electrical box having a bottom wall, side walls, and an open top with the side walls having a height no greater than t. The box is joined to the beam member with the bottom of the box in direct contact with the beam and the walls of the box extending outwardly through the ceiling layer. A rigid metal plate or disk member adapted for supporting and mounting a ceiling fan is positioned over the open end of the electrical box. Such members come in a variety of size and shapes some of which have outer peripheries substantially equal to the opening of the box while others have peripheries which extend outwardly radially beyond the walls of the box into engagement with the surrounding ceiling layer. Mounting screws extend upwardly through the metal plate or disk support member and through the box into connected engagement with the beam for supporting the support member from the beam without reliance on the electrical box.

As can be seen from the foregoing, the metal member is entirely supported from the beam by the mounting screws and the box member performs no load carrying function relative to the metal support disk or plate. The metal disk or plate can, of course, be provided with downwardly extending support members to which the fan can be attached. Alternatively, the support member can include threaded openings for receiving fan supporting bolts or the like. In any event, the support member can substantially close the open lower end of the electrical box to enclose the wiring or any electrical connections which may have been made within the box.

In accordance with a more limited aspect of the invention, the electrical box is preferably formed of plastic and is connected to the beam member by screws extending through the bottom of the box. Additionally, it is preferred that the electrical box have openings in its bottom wall which align with the openings for the mounting screw members in the support disk or plate member. The member is thus positively aligned with the electrical box and the surrounding ceiling surface by positioning of the mounting screws through the openings in the electrical box.

The assembly can be used in new construction or existing construction. For existing construction, the box should preferably have a thickness t, i.e., the height of the side walls, which is no greater than the thickness of the overlying wall materials such as plasterboard, dry wall, or plaster and lath overlay. With the shallower box, the box side walls can still end at the ceiling surface. For new construction, the same arrangement can generally be provided but the box can have a greater depth and the box support joist or beam can be separately installed prior to installation of the dry wall or plaster lath material. In such a case, the supporting member can be a wood beam extending between adjacent ceiling joists or rafters or the floor joists of the superjacent floor.

As can be seen from the foregoing, a primary object of the invention is the provision of a highly simplified method and assembly for mounting ceiling fan structures in a way which prevents or eliminates the use of the electrical box as a load supporting member for the fan structure.

A still further object of the invention is the provision of an assembly of the general type described which uses extremely simple components and can be readily used in either new or old construction.

Yet another object of the invention is the provision of a fan mounting assembly wherein the electrical boxes can be relatively inexpensive molded plastic boxes since they are not required to carry any substantial portion of the fan weight.

BRIEF DESCRIPTION OF THE DRAWINGS

The above and other objects and advantages will become apparent from the following description when read in conjunction with the Accompanying drawings wherein:

FIG. 1 is a vertical cross-sectional view through a ceiling structure wherein the preferred form of the invention is illustrated;

FIG. 2 is an enlarged vertical cross-sectional view of the circle portion of FIG. 1;

FIG. 3 is a view taken on line 3—3 of FIG. 2 (a portion is broken away to more clearly show the construction);

FIG. 4 is a cross-sectional view similar to FIG. 1 but showing a second embodiment of the invention particularly intended for use in existing construction;

FIG. 5 is an enlarged view of the circled area of FIG. 4;

FIG. 6 is a view taken on line 6—6 of FIG. 5; and,

DETAILED DESCRIPTION OF THE PREFERRED AND ALTERATIVE EMBODIMENTS

Figure 7:
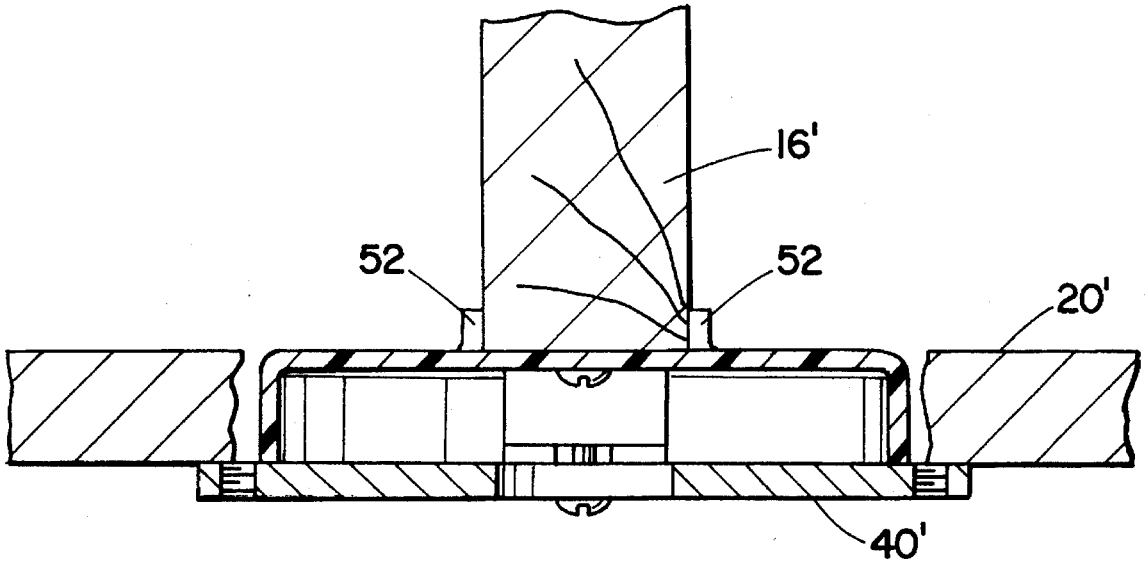
FIG. 7 is a cross-sectional view taken on line 7—7 of FIG. 5.

Referring more particularly to the drawings wherein the showings are for the purpose of illustrating preferred and alternate embodiments of the invention only, FIG. 1 shows the overall arrangement of a preferred fan mounting assembly as installed according to the invention and used in new construction. The assembly 10 generally comprises an electrical box and fan support arrangement 12 which is suitably connected and carried from the ceiling structural beam member 14. Generally, the fan support arrangement is provided by the fan manufacturer. The structural members are shown somewhat diagrammatically and generally include a first parallel extending pair of wooden beams or members 16 that are spaced and function as ceiling joists or rafters or as joists for the next superior floor in the building structure. For subject purposes, however, beam members 16 will be referred to as joists. Installed during the original construction and spaced upwardly from the lower edges 16*a* of the joists 6 is a transversely extending wooden beam or support member 8. Typically, for most purposes, the joists 6 would be spaced apart 16 inches on center and the member 8 could comprise a conventional nominal two-by-four member. The ceiling surface structure in the FIG. 1 embodiment is defined by a dry wall or plaster board sheet member 20 which is suitably joined to and supported in engagement with the lower surfaces 16*a* of the joists 16.

As best illustrated in FIG. 2, the electrical box and fan support assembly 2 generally is supported from the beam member 18 and includes a relatively standard, molded plastic electrical ceiling box 24 that has a bottom wall 26 and side wall members 28. The actual crosssectional shape of the box is not of particular importance, and it can be square, round, octagonal, or any shape having the general characteristics as will become apparent from the following description. Of importance to the overall arrangement is that the height of the side walls of the box be preferably substantially equal to the distance t which is the distance from the lower edge surface of the beam 18 to the outer surface of the panel or ceiling member 20. The box has its open top as defined by the terminal periphery edges of the walls 28 facing downwardly and of open design.

The box 24 is mounted in direct engagement with the lower surface of the beam 18 by suitable fasteners such as screws 32 or the like which are positioned to extend through the bottom of the box and support the box in its located position as shown. Preferably, sheet metal screws are used to fasten and support the box. Wiring can enter through the window clamps (not shown) located in the bottom of the box. The ceiling panel member 20 is, of course, cut away around the outer walls of the box to provide a suitable opening 34 through which the box extends with its open top facing into the room area beneath the ceiling panel member 20. Since the screws 32 support and are responsible for supporting only the box structure, they do not need to be of any particular load carrying capability since the box itself is a relatively lightweight, molded plastic structure, however, it can be a standard metal box if desired. In any event, the box is positioned in place and suitable wiring as required is brought in through side wall or bottom wall windows of the box in the space above the ceiling panel 20. The wiring (not shown) forms no part of the subject invention.

Associated with the box and arranged to support the ceiling fan structure or other heavy electrical components in a manner which does not rely on the box itself is a rigid metal mounting or support plate or disk member 40 best seen in FIGS. 2 and 3. The member 40 is preferably formed from a rigid metal plate of steel and desirably has a circular outer periphery 42 (FIG. 3). It should be appreciated, and will become apparent from the description which follows however, that the support member 40 could be of a variety of shapes. In this embodiment, the outer periphery is preferably of a size so as to completely overlie and extend beyond the outer limits of the side walls 28 of the electrical box 24 as well as to completely overlie and cover up the ceiling through opening 34. Alternatively, the outer periphery may be of a size less then or equal to the box opening which facilitates placement of a separate fan canopy for covering the ceiling opening.

Preferably, the member 40 is provided with a plurality of through openings 44 that are located and sized so as to lie within the confines of the open top of the box 24 when the member 40 is placed in aligned position overlying the box in the manner shown in FIGS. 2 and 3. These openings are also preferably shaped and sized so as to allow them to receive relatively long screws 46 which can extend from the member 40 upwardly through clearance holes in the box adjacent the side walls 28 and into the support member 18. Mounting screws having a Phillips drive head provide the most suitable means for supporting the plate member 40 from the beam. As illustrated in FIGS. 2 and 3, the heads of the screws 46 are preferably arranged so as to engage and support the member 40. The openings 44, in this embodiment, allow the heads of the screws 46 to enter and support the member 40.

Although not absolutely necessary, it is highly desirable that the openings 44 be spaced laterally apart a distance corresponding to the spacing of the clearance openings formed through to the bottom of the box 24. That is, the box 24 is preferably provided with sets of openings 24*a* that are spaced to correspond to the spacings of typical openings 44. This arrangement thus assures that the member 40 will be properly located and centered relative to the box 28 when the screws 46 are positioned to extend through the openings 24*a*. The member 40 is then properly located.

Since the support plate member 40 is carried entirely by the screws, it transmits no load to the box, and the box acts merely as an electrical enclosure or connecting area for the fan wiring.

The plate member 40 is also provided with means to allow connection of the fan support structure or housing components generally provided with the ceiling fan structures. For example, a plurality of suitable threaded openings 54 are formed in plate 40. It should be appreciated that plate 40 could have other types of openings threaded or unthreaded for receiving the fasteners or connectors used to join fan support structure to the plate 40.

As can be seen from the foregoing, the various components are related such that no tension loads are conducted from the fan support brackets through to the box 26 and all loads are connected directly to building beams and support structure capable of carrying the actual fan loading.

FIGS. 4 through 6 illustrate a second embodiment of the invention which is particularly intended for use in existing building structures to allow ceiling fans and the like to be supported in a safe manner without relying on the electrical box per se.

The FIGS. 4 through 5 embodiment uses components that are basically the same as discussed with reference to FIGS. 1 through 3. Accordingly, the same or similar components have been denoted with the same reference numeral differentiated by a prime (') suffix. The description of such an element is to be taken as the same as the FIGS. 1 through 3 embodiment unless otherwise noted. In particular, the primary difference between the FIGS. 1 through 3 embodiment and the FIGS. 4 through 6 embodiment is that in the FIGS. 4 through 6 embodiment the arrangement is designed such that it can be used to mount a fan or similar structure directly in place without installing additional rafters, joists, or beams in the existing structure. Note that the box 24' is designed so as to have side walls which are the same height as the thickness of the overlying ceiling panel be it dry wall or a lath-plaster structure. In the embodiment illustrated, the distance t is, for example, ½ inch as the result of using a dry wall or plaster board of ½ inch thickness. That is, the depth of the box is ½ inch so that when the support plate 40 is moved into positioned and mounted therein by the screws 46', it overlies and directly engages about the periphery of the opening 34'. In any event, the distance t is selected to provide at least 8 cubic inches of internal box capacity. All of the load generated from the fan and conducted to the plate 40' is conducted through the screws 46' and supported from the existing rafter or joist 16'.

The box 24' is preferably, in other particulars, similar to the box 24 of the FIGS. 1 through 3 embodiment. Likewise, it could be formed either of plastic or metal. It could also include (see FIG. 7) a pair of raised ribs 52 positioned on the external surface of the box bottom wall to facilitate alignment of the box fastener opening with the beam centerline. The pair of raised ribs 52 would extend in a parallel fashion and are separated by a distance substantially equal to the beam thickness. Note that in installing a fan using this system, it is necessary only to cut through the existing dry wall at a location wherein direct connection with the beam 16' can take place. It is not necessary to enter into the space between the ceiling joists or rafters with cross-braces, or cross-supports, or any similar structures. As can be appreciated, this greatly facilitates installation of ceiling fans and the like into existing structures.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An assembly for mounting a ceiling fan comprising:

a support beam member with a ceiling layer of a thickness t carried thereby;

an electrical box having a bottom wall, side walls, and an open top, said walls having a height no greater than t;

said box being directly joined to the beam member with the bottom of the box in direct contact with the support beam member and the walls of the box extending outwardly through the ceiling layer;

a rigid metal plate member adapted for supporting and mounting a ceiling fan, said plate member positioned over the open end of the electrical box and being of sufficient size to have a peripheral portion extending radially outwardly beyond the walls of the box; and, mounting screw members extending upwardly through the plate member and through the electrical box into connected engagement with the beam for supporting the plate member from the beam member without reliance On the electrical box.

2. The mounting assembly as defined in claim 1 wherein the electrical box is formed of a plastic and the support beam member is a wood joist and the electrical box is connected to the joist by screws extending through the bottom of the box.

3. The mounting assembly as defined in claim 1 wherein the plate member has openings formed therethrough for connection with a fan support base.

4. The mounting assembly as defined in claim 1 wherein the plate member is of flat circular configuration.

5. The mounting assembly as defined in claim 1 wherein the bottom of the electrical box and the plate member have preformed aligned openings for allowing the mounting screw members to pass directly through the bottom of the electrical box.

6. A mounting assembly for supporting a fan from a ceiling including:

a first layer of material defining a ceiling having a downwardly facing exposed ceiling surface and a thickness t;

a support beam located inwardly of the exposed ceiling surface at least a distance t;

an electrical box having a bottom wall directly joined to and supported from said support beam, said box having side walls extending from the bottom wall through the first layer substantially to the exposed ceiling surface and terminating in an open end;

a rigid metal plate member adapted for supporting and mounting a ceiling fan, said plate member positioned over the open end of the box and being of a size sufficient to have a peripheral portion extending radially beyond the side walls of the box; and, a plurality of mounting screws extending from the plate member through the interior of the box into connected engagement with the beam for supporting the plate member from the beam without reliance on the electrical box.

7. A mounting assembly as defined in claim 6 wherein the mounting plate is a flat metal member having a means formed therein for receiving a fan mounting member.

8. A mounting assembly as defined in claim 7 wherein the electrical box is a molded box directly connected to the support beam member by screws passing directly through the bottom wall of the electrical box into the support beam member.

9. A mounting assembly as defined in claim 8 wherein the mounting plate has an opening formed therethrough to permit access to the interior of the electrical box while the mounting plate is in position over the open end of the electrical box.

10. A mounting assembly as defined in claim 8 wherein the electrical box includes a pair of parallel ribs integrally formed on an external surface of the bottom wall for aligning the electrical box with the support beam.

* * * * *